US011166489B2

(12) United States Patent
Sutton

(10) Patent No.: US 11,166,489 B2
(45) Date of Patent: Nov. 9, 2021

(54) FILTER UNIT FOR ELECTRONIC CIGARETTES

(71) Applicant: Isaac Sutton, Brooklyn, NY (US)

(72) Inventor: Isaac Sutton, Brooklyn, NY (US)

( * ) Notice: Subject to any disclaimer, the term of this patent is extended or adjusted under 35 U.S.C. 154(b) by 199 days.

(21) Appl. No.: 16/544,978

(22) Filed: Aug. 20, 2019

(65) Prior Publication Data

US 2021/0052015 A1 Feb. 25, 2021

(51) Int. Cl.
*A24D 3/10* (2006.01)

(52) U.S. Cl.
CPC ..... *A24D 3/10* (2013.01)

(58) Field of Classification Search
CPC ..... A24D 3/10; A24D 3/17
See application file for complete search history.

(56) References Cited

U.S. PATENT DOCUMENTS

2018/0352856 A1* 12/2018 Sebastian ..... A24D 3/10
2019/0029319 A1* 1/2019 Moorman ..... A24F 40/485

* cited by examiner

*Primary Examiner* — Eric Yaary
*Assistant Examiner* — Jennifer A Kessie
(74) *Attorney, Agent, or Firm* — Anna Vishev

(57) ABSTRACT

A filtering unit for use with an electronic cigarette which includes a hollow housing and a filter pad located inside the housing. The housing has a first end, a second end, a front wall, and a rear wall. The front wall and the rear wall extend from the first end to the second end of the housing. The hollow housing also including a throughgoing opening formed at the second end and at least one pair of first internally extending prongs, these first prongs forming an internal chamber. The filter pad is positioned inside the internal chamber of the hollow housing. The second end of the hollow chamber is positionable over a portion of the electronic cigarette so as to filter out undesired particles in vapors of the electronic cigarette.

4 Claims, 14 Drawing Sheets

FILTER UNIT FOR ELECTRONIC CIGARETTES

BACKGROUND OF THE INVENTION

This application and its disclosure generally relate to the field of electronic cigarettes.

Vaping, aka smoking e-cigarettes, is a trend that's skyrocketed in popularity over the last few years, especially among teenagers, for whom e-cigarettes are actually illegal. Regular cigarettes burn tobacco, creating a smoke that the user inhales. E-cigarettes, on the other hand, don't burn anything. The technology consists of a small coil wrapped around a wick. The apparatus is soaked in a liquid, usually propylene glycol, vegetable glycerin, flavorants, and nicotine. Heating the coil around the saturated wick creates a vapor of ultrafine particles, including nicotine, which users breathe into their lungs. Both cigarettes and e-cigarettes generate aerosols of ultrafine particles in order to give its users a hard nicotine hit. Further, according to some studies, flavored ingredients in some electronic cigarettes combust to create toxic chemicals that are not listed on the label and could cause lung damage. Therefore, it is desirable to provide a filtering mechanism for filtering out the undesired particles and toxic chemicals.

Some e-cigarettes incorporate internal filtering. However, none of the existing e-cigarettes offer a separate filtering unit, which can be selectively attached to the e-cigarette to filter out undesired particles and toxic chemicals.

SUMMARY OF THE INVENTION

In its general aspect, the apparatus is a filtering unit for use with an electronic cigarette that includes a hollow housing and a filter pad located inside the housing. The housing has a first end, a second end, a front wall, and a rear wall. The front wall and the rear wall extend from the first end to the second end of the housing. The hollow housing also including a throughgoing opening formed at the second end and at least one pair of first internally extending prongs, these first prongs forming an internal chamber. The filter pad is positioned inside the internal chamber of the hollow housing. The second end of the hollow chamber is positionable over a portion of the electronic cigarette so as to filter out undesired particles in vapors of the electronic cigarette.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of examples which are not a limitation, and the figures of the accompanying drawings in which references denote corresponding parts, and in which.

DETAILED DESCRIPTION OF THE INVENTION

As illustrated in the attached Figures, the apparatus of the present invention is designed to attach to a conventional electronic cigarette and to filter out particles and chemicals before they are inhaled by the user.

Figure 1:
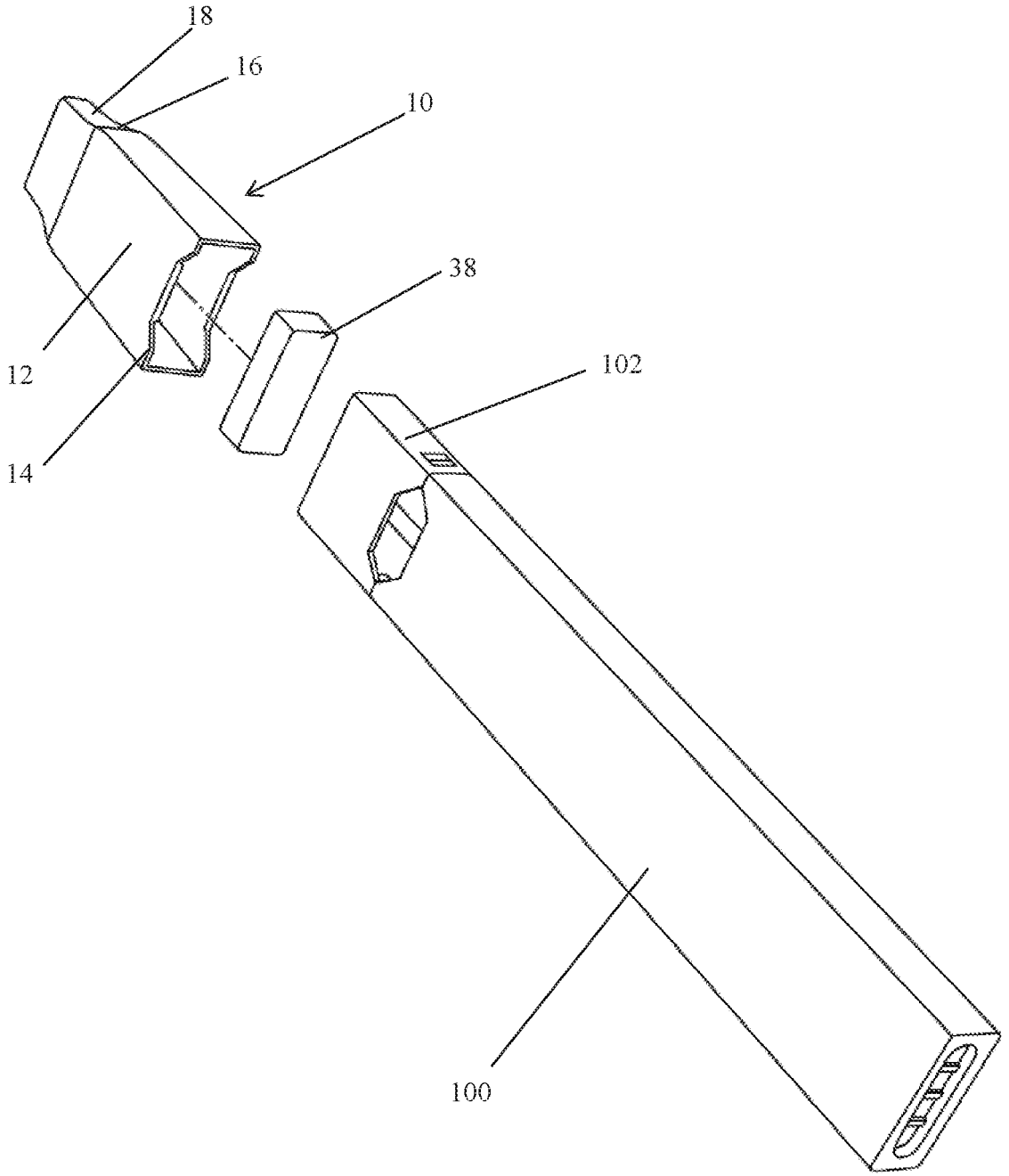
FIG. 1 is an exploded perspective view of a first type of electronic cigarette with a filtering unit of the present invention.
Figure 2:
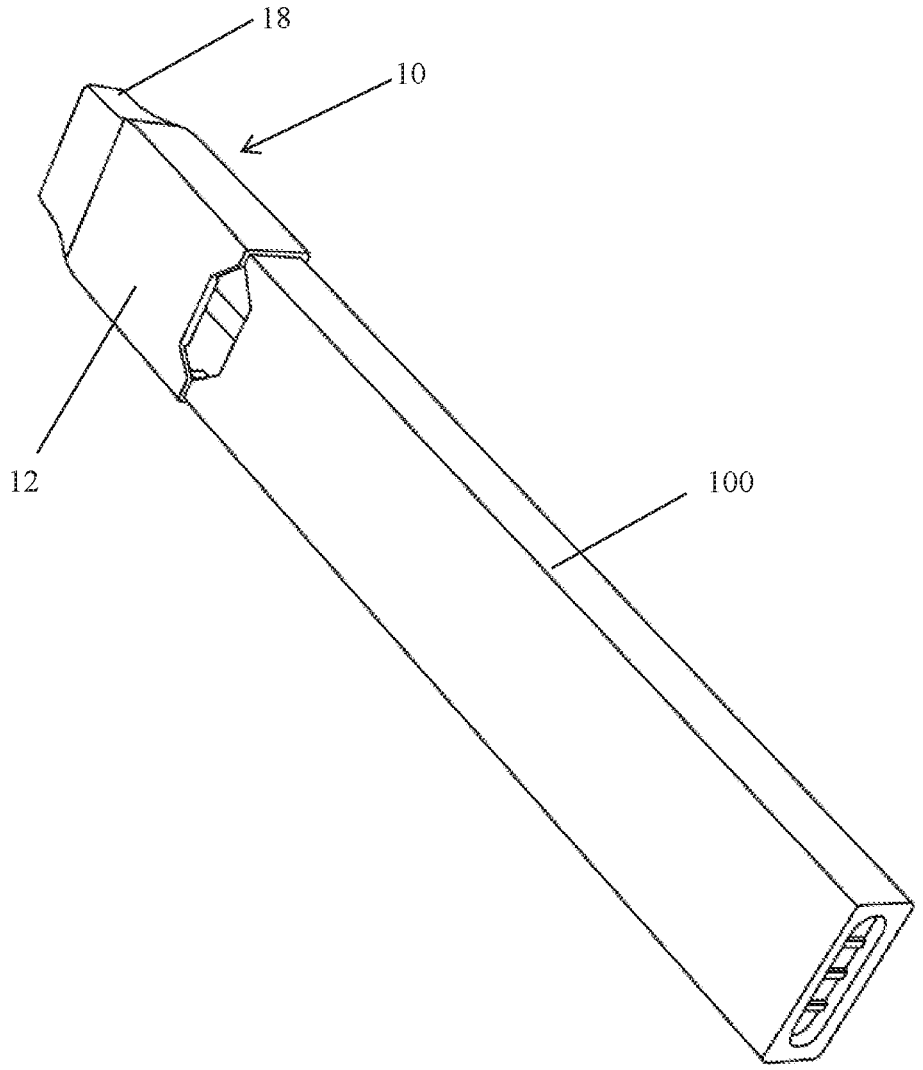
FIG. 2 is a perspective view of the assembled first type of electronic cigarette with the filtering unit of the present invention.
Figure 3:
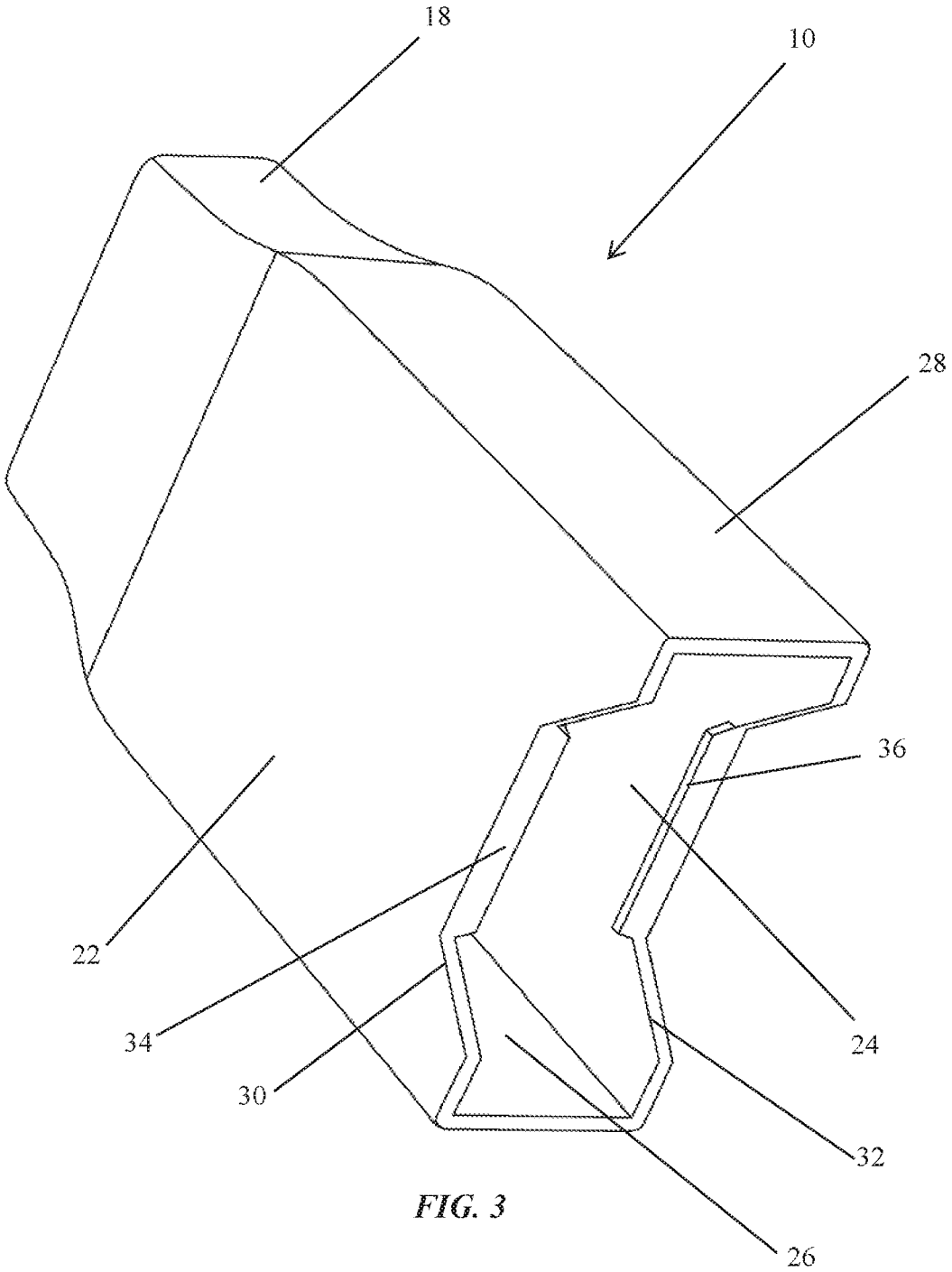
FIG. 3 is a perspective view of the filtering unit of the present invention.
Figure 4:
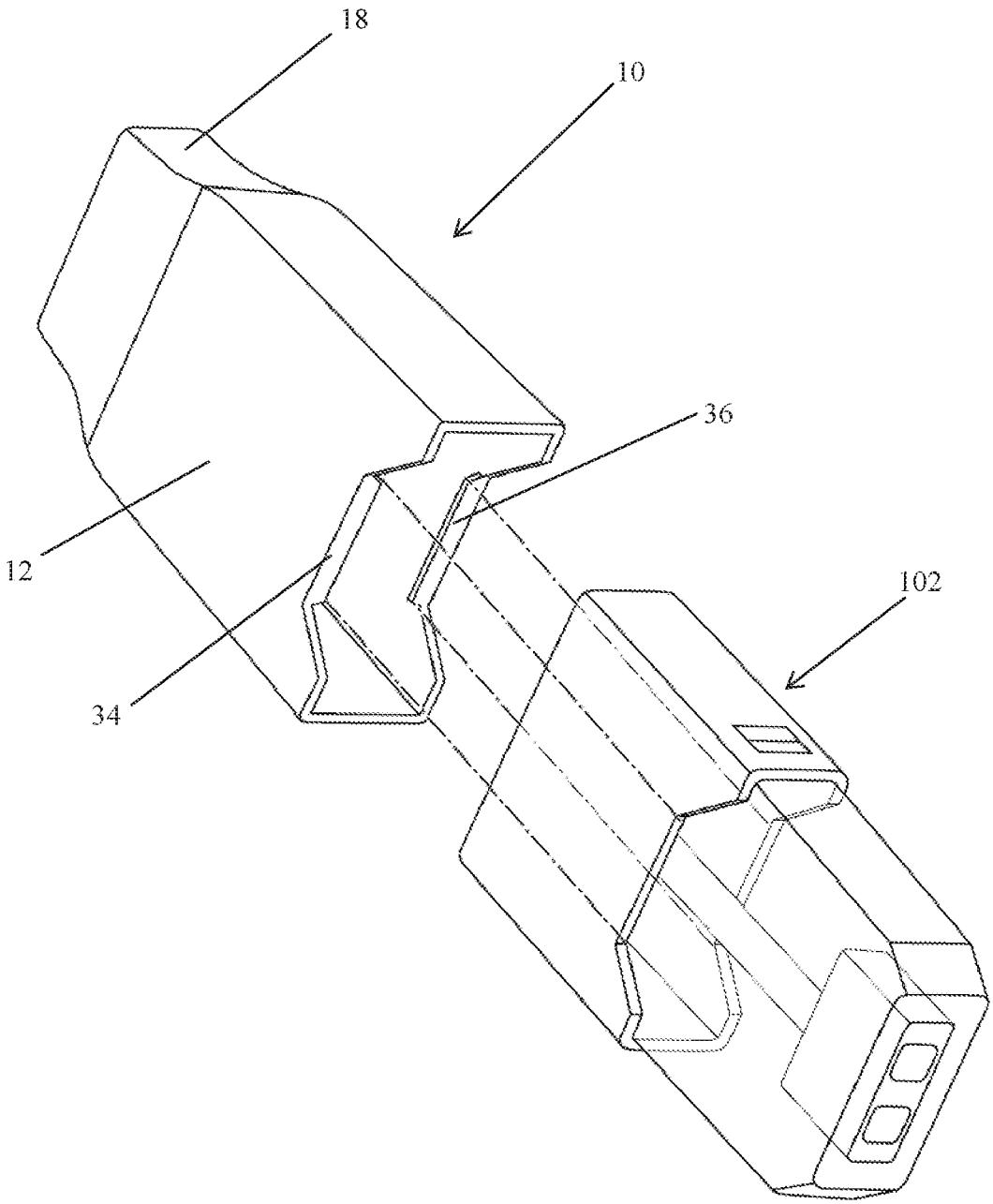
FIG. 4 is an exploded perspective view of a pod of the first type of electronic cigarette and the filtering unit of the present invention.
Figure 5:
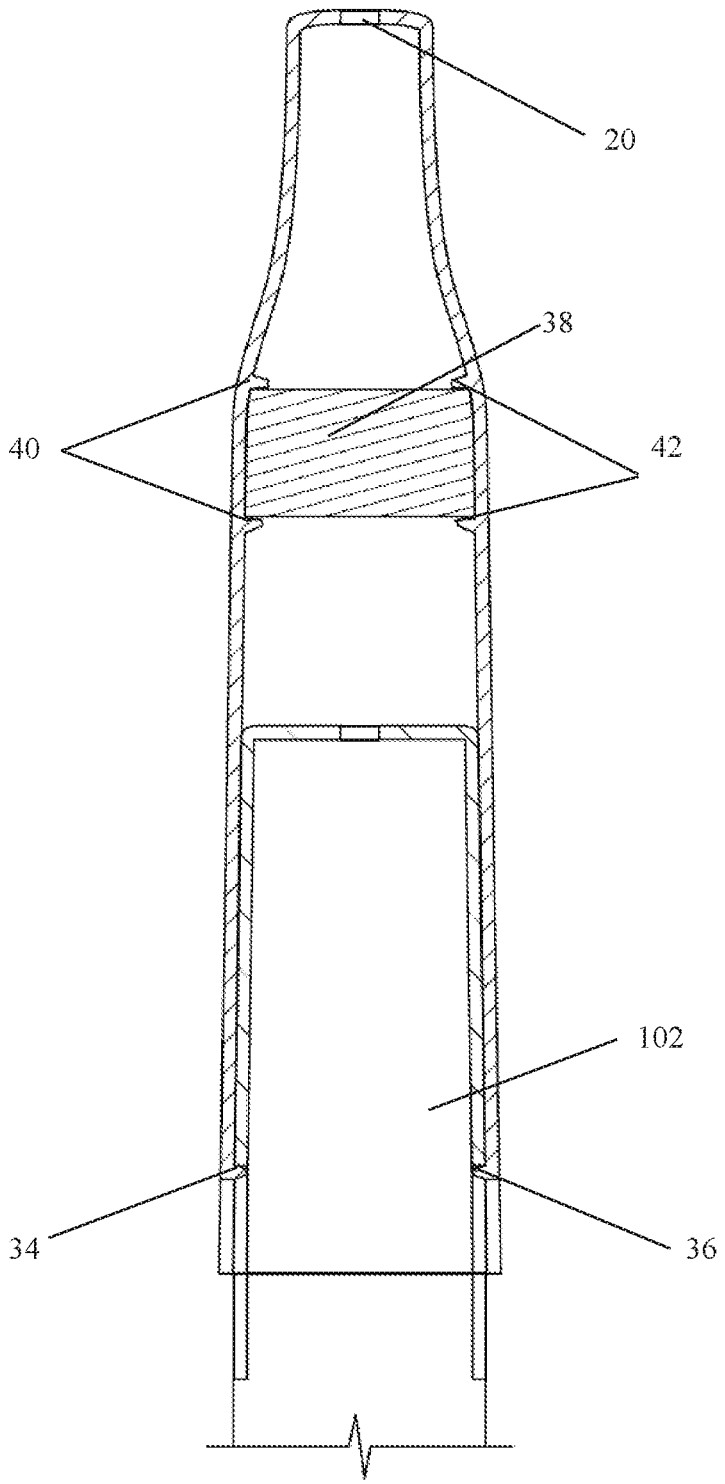
FIG. 5 is a cross-sectional view of the assembled first type of electronic cigarette with the filtering unit of the present invention.

As shown in FIG. 1, a typical electronic cigarette includes a charging unit 100 and a pod unit 102. In the preferred embodiment, illustrated in FIGS. 1-5, the filtering unit 10 is a relatively small unit having a hollow housing 12 with a first end 14 and a second end 16. A mouthpiece 18 is preferably formed at the second end 16. A throughgoing opening 20 (shown in detail in FIG. 5) is formed in the mouthpiece 18 allowing the vapors to pass from the pod unit 102 through the housing and into the user's mouth. The housing 12 also includes a front wall 22, rear wall 24 and two side walls 26 and 28, respectively. All walls of the housing 12 extend between the first end 14 and the second end 16. The front wall 22 and rear wall 24 preferably have notches 30 and 32, respectively, to better accommodate at least a portion of the pod unit 102. Further, each notch 30, 32 includes a prong 34, 36, respectively. As shown in FIGS. 2, 4 and 5, prongs 34 and 36 are designed and sized to securely attach to the upper portion of the pod unit 102, so as to securely mount the filtering unit 10 on the pod unit of the electronic cigarette. In the preferred embodiment, prongs 34 and 36 are designed so as to permanently and non-removably attach to the pod unit. However, prongs 34 and 36 can also be sized to enable the user to selectively remove the filtering unit 10 from the pod unit.

As shown in FIGS. 1 and 5, filtering unit 10 further includes a filter pad 38 placed inside the hollow interior of the housing 12. In the preferred embodiment, two pairs of internal prongs 40, 42 are formed on walls of the housing 12. Internal prong pairs 40 and 42 are spaced from each other so as to form an internal chamber sized to accommodate and hold therebetween the filter pad 38. In the preferred embodiment, filter pad 38 is made of treated cellulose acetate fiber. However, as will be apparent to a person skilled in the art, any other suitable filtering material can be utilized. Such other materials can be selected to filter out more particles and chemicals from the vapors. Further, more than one filtering pad can be utilized with the present invention for increased filtering.

Figure 8:
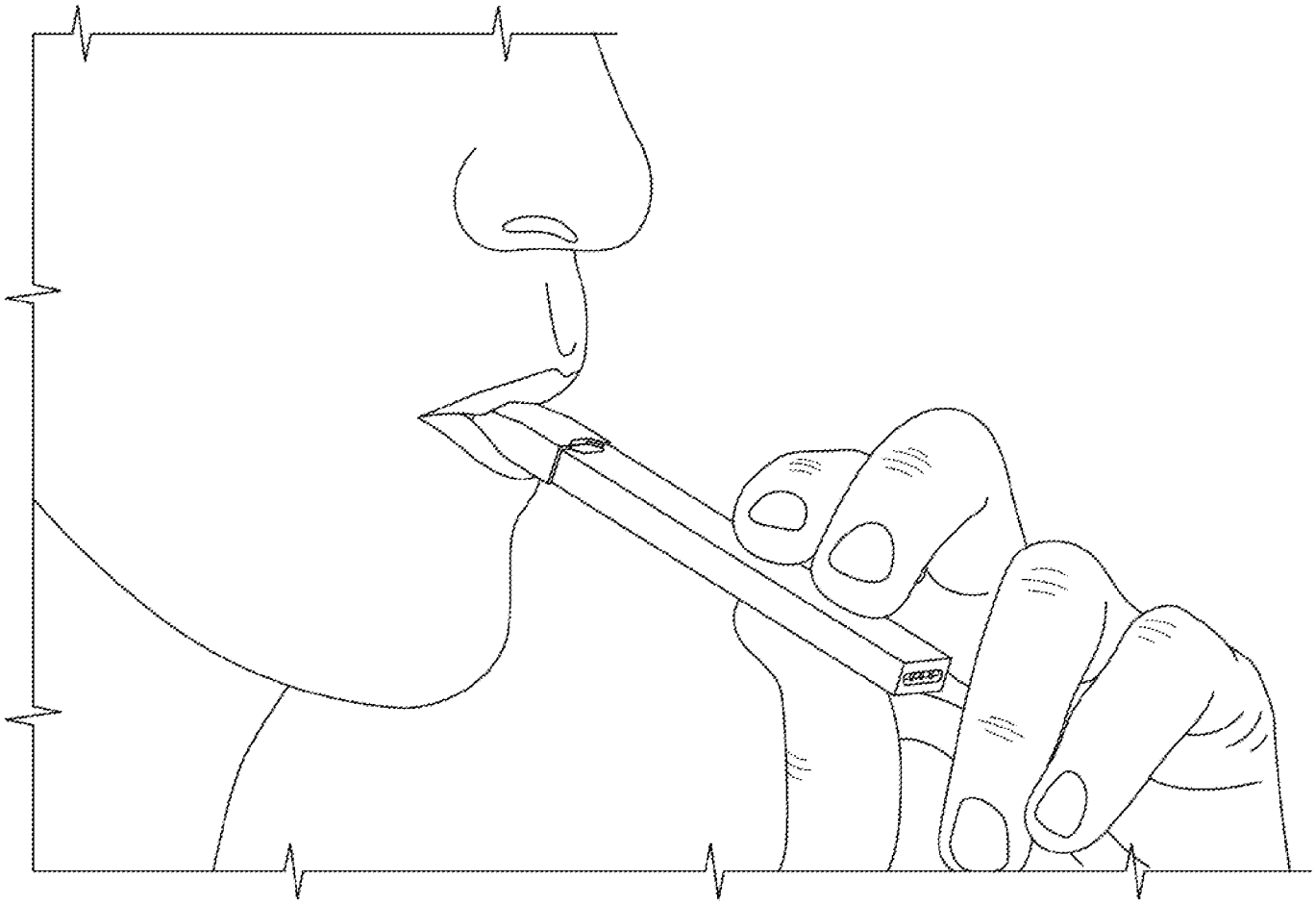
FIG. 8 is a view illustrating use of the first type of electronic cigarette with the filtering unit of the present invention.
Figure 9:
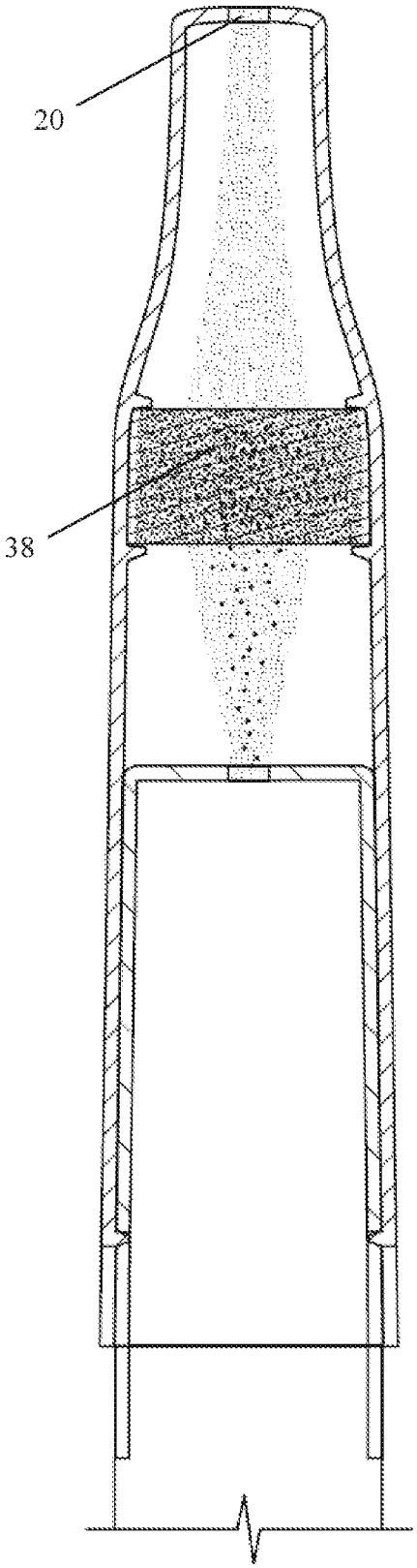
FIG. 9 is a cross-sectional view illustrating use of the first type of electronic cigarette with the filtering unit of the present invention.
Figure 10:
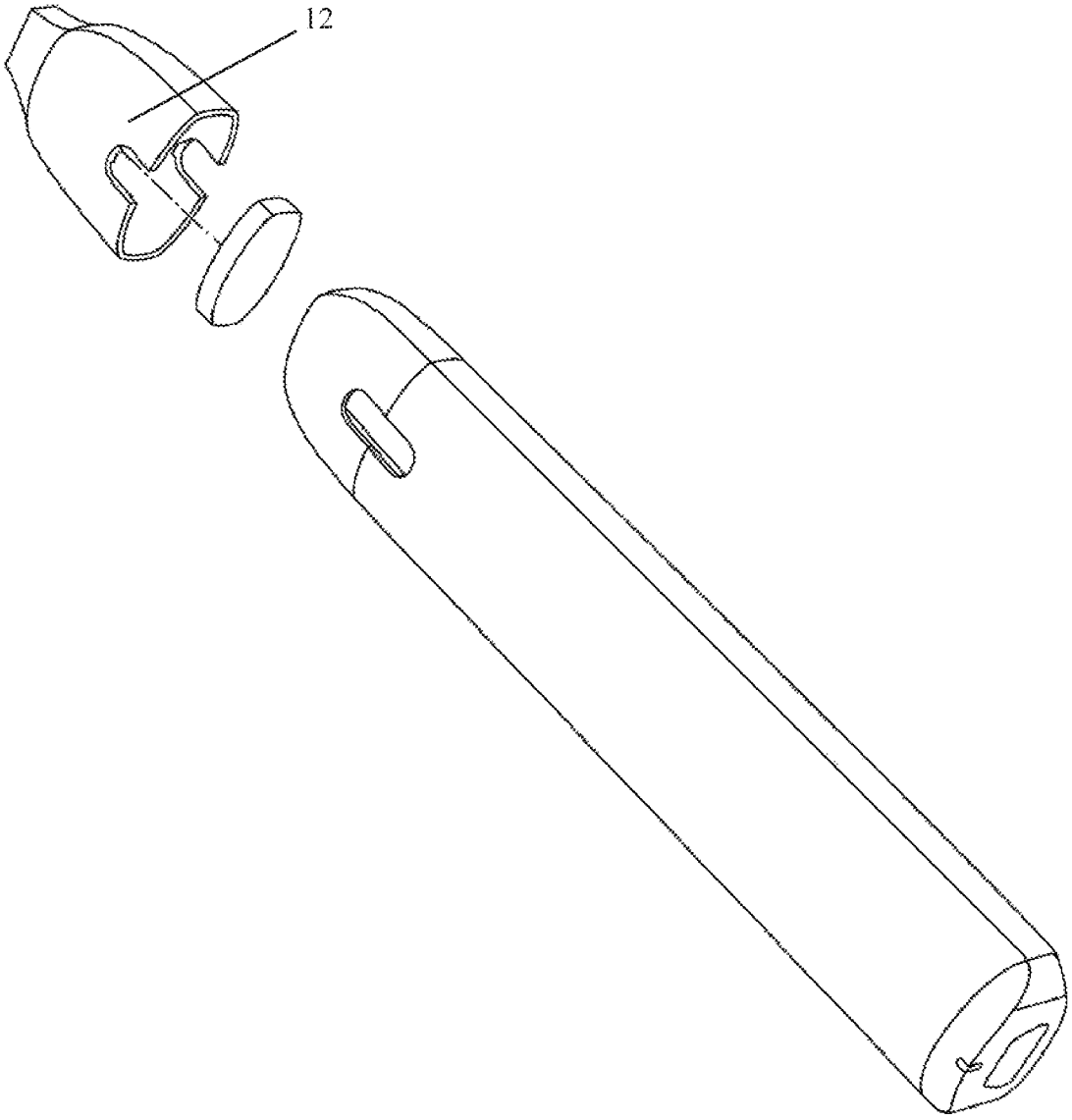
FIG. 10 is an exploded perspective view of a second type of electronic cigarette with a second alternative embodiment of the filtering unit of the present invention.
Figure 11:
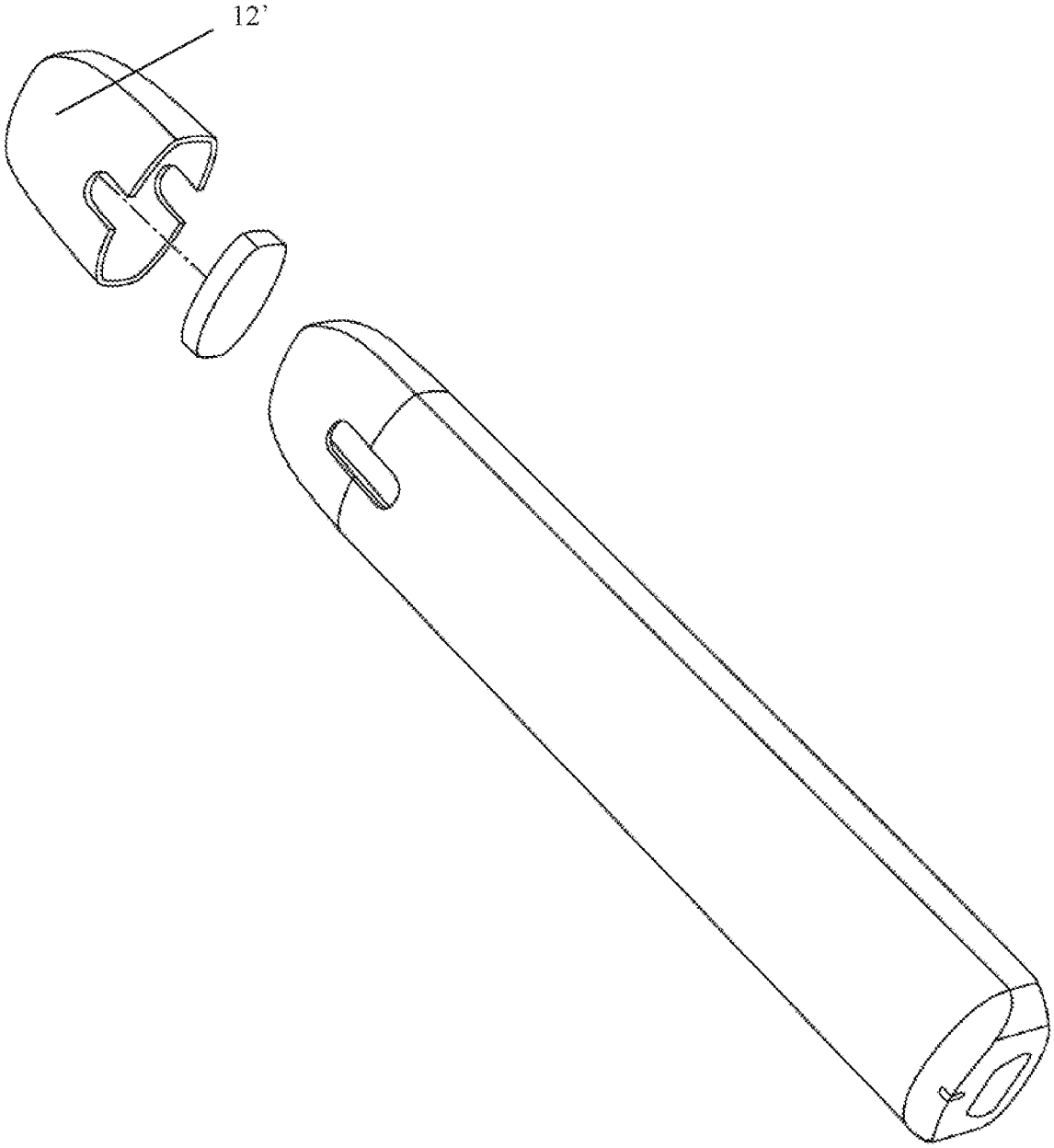
FIG. 11 is an exploded perspective view of a second type of electronic cigarette with a third alternative embodiment of the filtering unit of the present invention.
Figure 12:
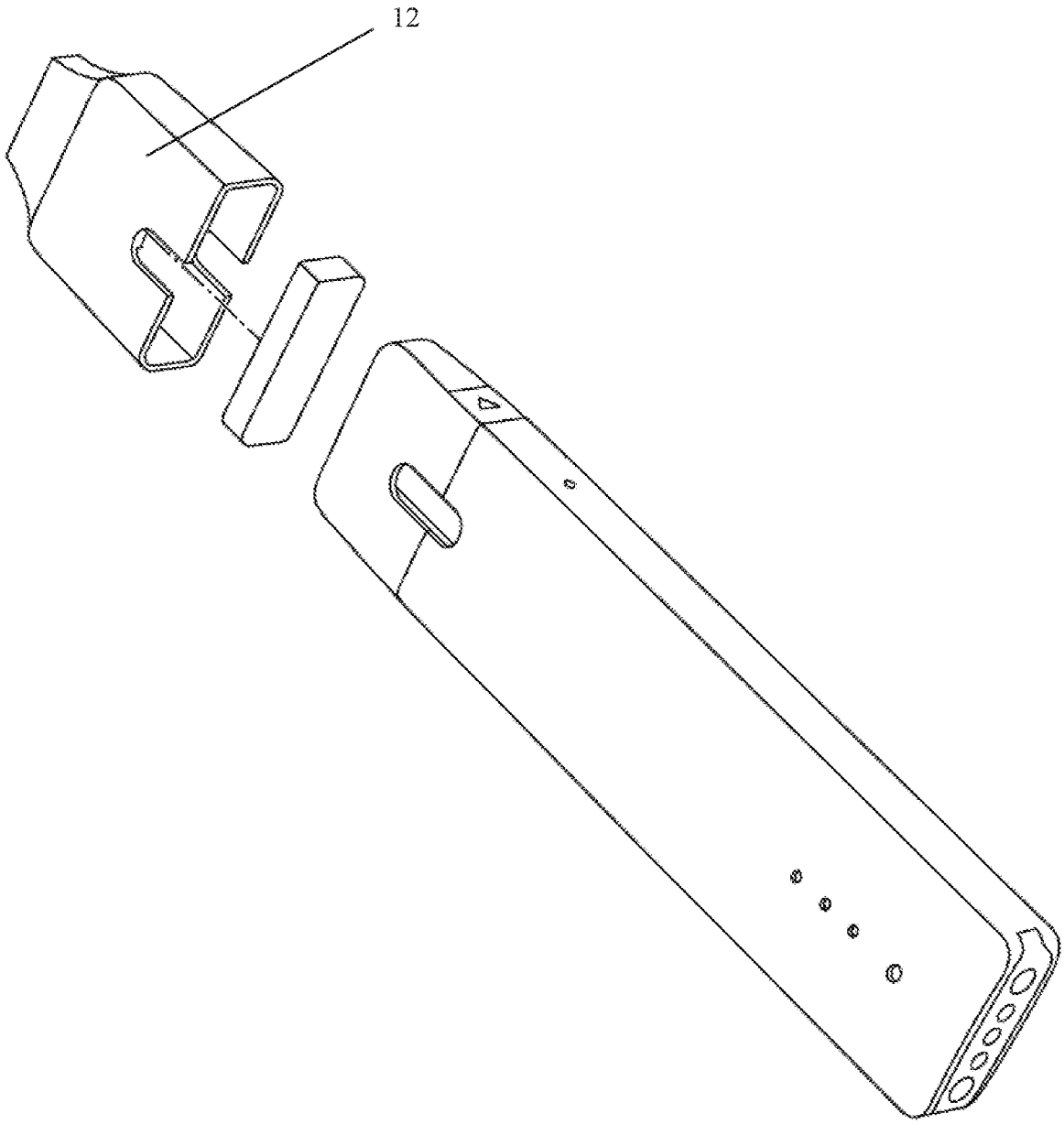
FIG. 12 is an exploded perspective view of a third type of electronic cigarette with a fourth alternative embodiment of the filtering unit of the present invention.
Figure 13:
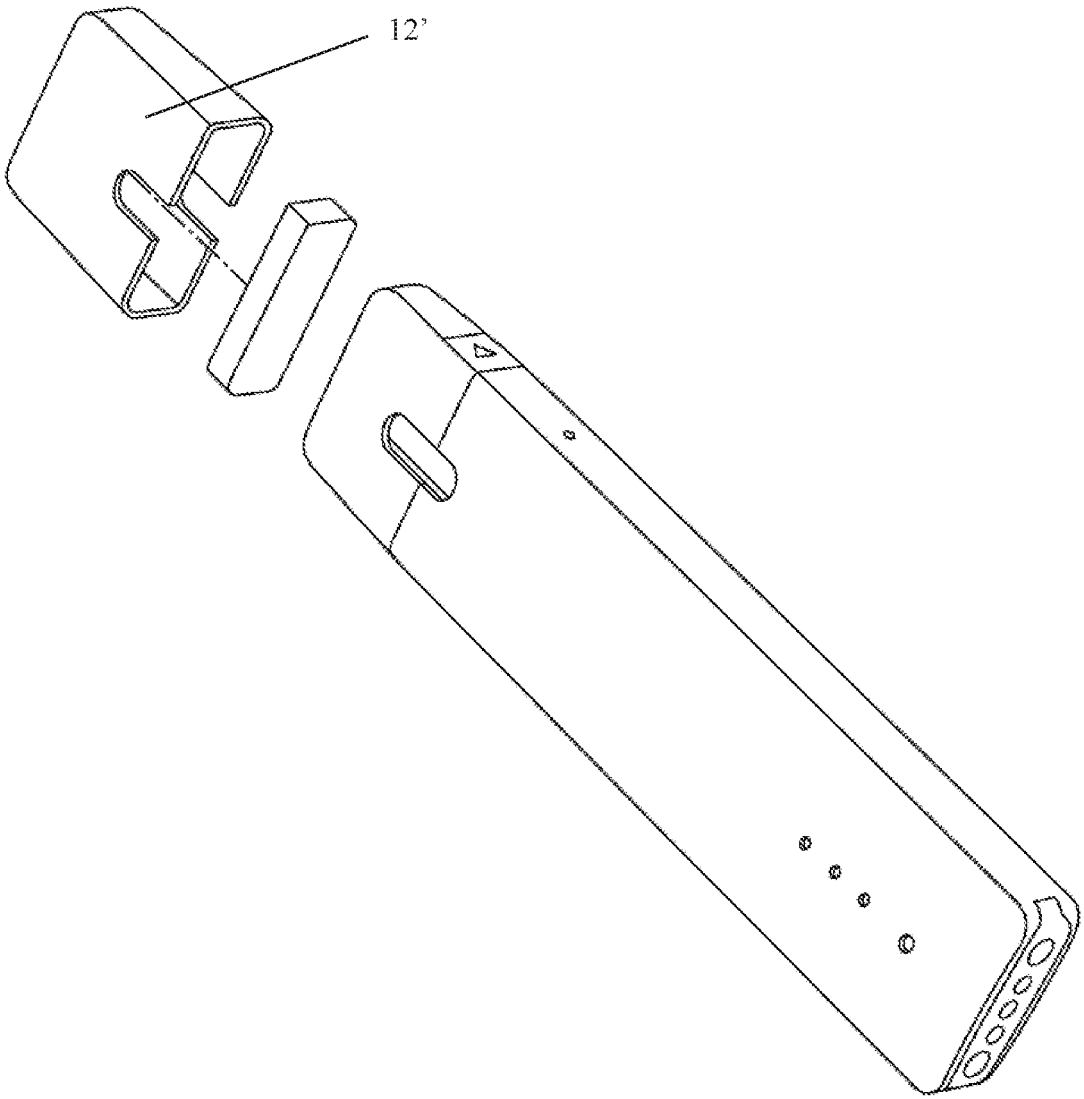
FIG. 13 is an exploded perspective view of a third type of electronic cigarette with a fifth alternative embodiment of the filtering unit of the present invention.

In use, the user will push the filtering unit 10, with the filter pad 38 already inserted therein, onto the pod unit 102 of the electronic cigarette until prongs 34 and 36 snap onto the upper portion of the pod unit, securely attaching the filtering unit with the inserted filter pad to the electronic cigarette. The electronic cigarette can then be used in a usual manner, as illustrated in FIG. 8. As shown in FIG. 9, the vapors heated by the charging unit pass through the filter pad 38 filtering out undesired particles and then into the user's mouth through the opening 20.

Figure 6:
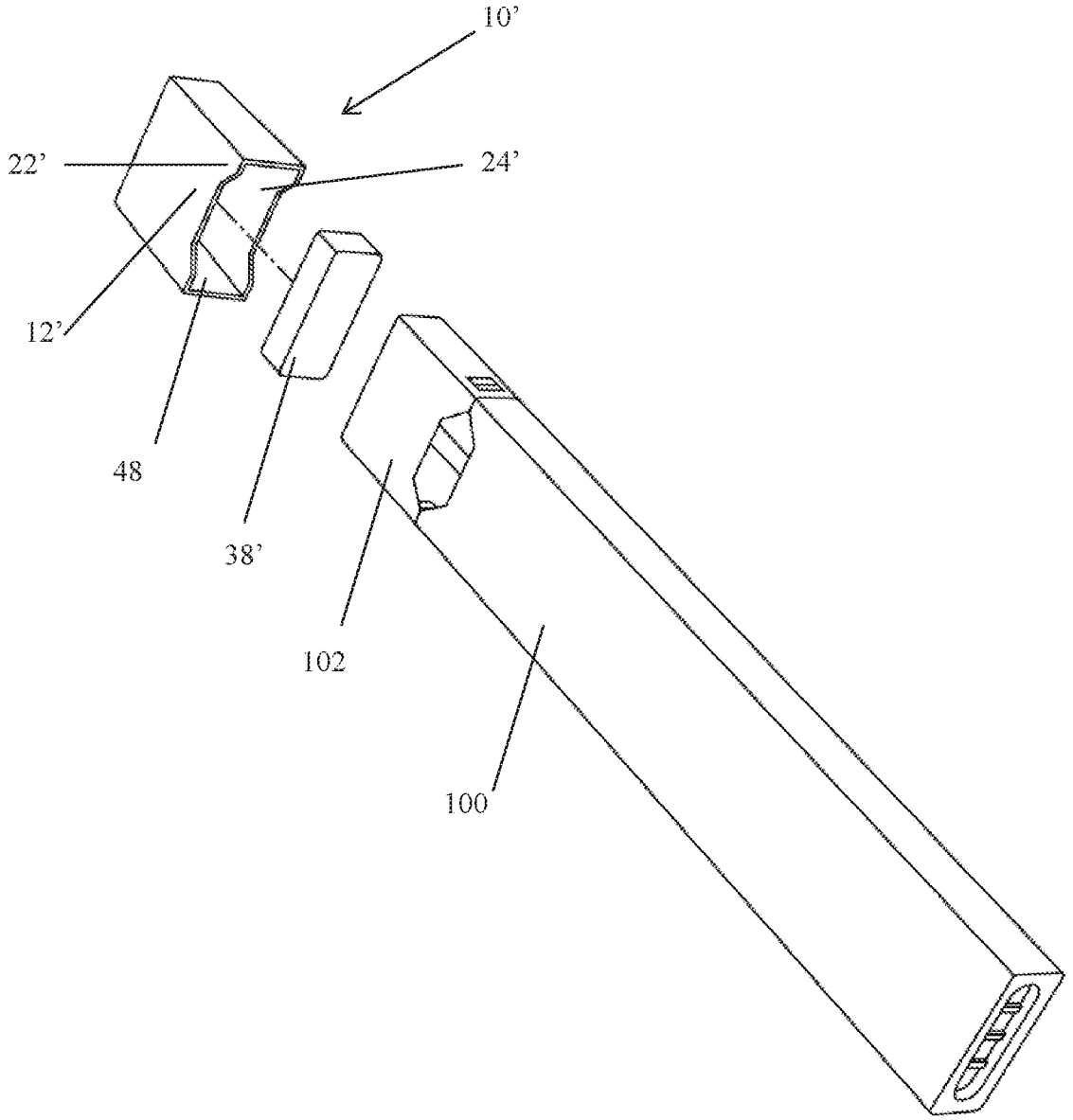
FIG. 6 is an exploded perspective view of a first type of electronic cigarette with an alternative embodiment of the filtering unit of the present invention.
Figure 7:
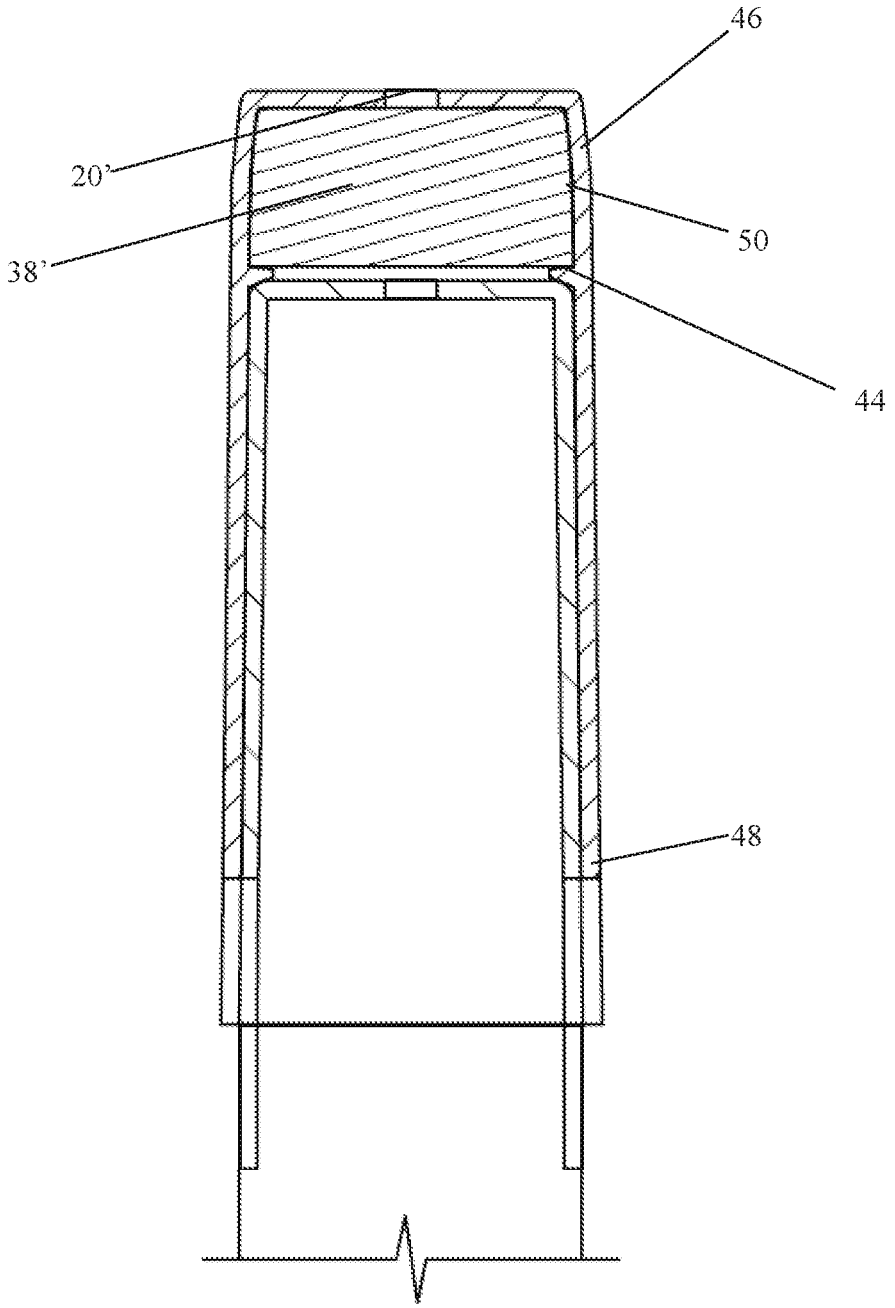
FIG. 7 is a cross-sectional view of the assembled first type of electronic cigarette with the alternative embodiment of the filtering unit of the present invention.

Another preferred embodiment of the filtering unit is illustrated in FIGS. 6-7. In this alternative embodiment, filtering unit 10' includes a hollow housing 12' having an upper portion 46 and a lower portion 48. The upper portion 46 includes a throughgoing opening 20' and one pair of internal prongs 44. Prongs 44 are positioned such that an internal chamber 50 is formed between the prongs 44 and the opening 20'. Chamber 50 is sized so as to accommodate the filter pad 38' positioned therein. Similarly to the first preferred embodiment, the lower portion 48 includes a front wall 22' and a rear wall 24'. However, in this alternative embodiment, walls 22' and 24' do not include any attachment prongs. The walls of the hollow housing 12' are simply pushed onto the upper part of the pod unit 102 so as to removably position the filtering unit 10' onto the electronic cigarette.

Figure 14:
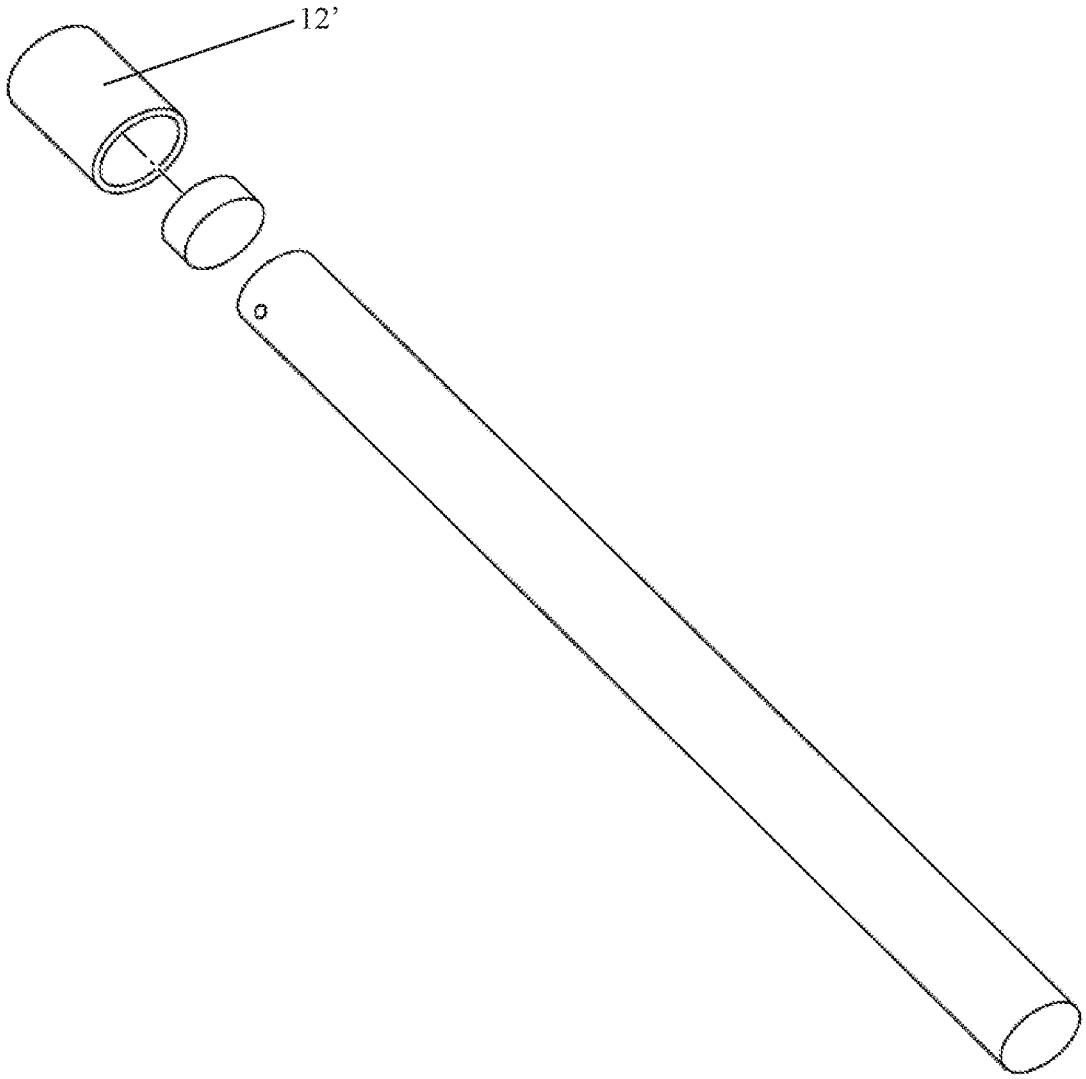
FIG. 14 is an exploded perspective view of a fourth type of electronic cigarette with a sixth alternative embodiment of the filtering unit of the present invention.

As shown in FIGS. 10-14, overall shape of the hollow housing 12 can vary depending on the shape of the pod unit 102 or the upper portion of a podless electronic cigarette (shown in FIG. 14).

It is empirically studied and concluded that the filtering unit 10 filters out undesired particles. The results of the empirical studies are recorded in Table 1 below. However, it should be understood by a person skilled in the art that the mechanism of the present invention is not limited to filtering out only the particles described below. Any other undesirable particles and chemicals produced by electronic cigarettes can be filtered out by the filtering unit 10 in the manner described in the present specification.

TABLE 1

| Analyte | Filtered Concentration (μg/pod) |
|---|---|
| Propylene Glycol | 4589.97 |
| Glycerin | 9169.03 |

TABLE 1-continued

| Analyte | Filtered Concentration (μg/pod) |
|---|---|
| Benzoic acid | 1002.25 |
| Triacetin | 23.55 |
| Nicotine | 2037.72 |
| Levomenthol | 115.53 |

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

I claim:

1. A filtering unit for use with an electronic cigarette, the filtering unit comprising:

a hollow housing having a first end, a second end, a front wall, and a rear wall, said front wall and said rear wall extending from said first end to said second end, said hollow housing further comprising a top portion located adjacent to said second end, a bottom portion located adjacent to said first end, a middle portion located between said top portion and said bottom portion, and a throughgoing opening formed at said second end, said hollow housing also comprising at least one pair of first internally extending prongs positioned within said middle portion, said first internally extending prongs forming an internal chamber in said middle portion; and a filter pad positioned inside said internal chamber of said hollow housing, wherein said front wall and said rear wall of said housing each further comprises an attachment prong located within said bottom portion at said first end and extending towards an interior of said housing, said attachment prongs being sized and configured to attach said first end of said filtering unit to said electronic cigarette, wherein said first end of said hollow chamber is positionable over a portion of said electronic cigarette such that said front wall and said rear wall of said housing protrude beyond an external profile of said electronic cigarette and said internal chamber with said filter pad is positioned above a vapor opening of said electronic cigarette so as to filter out undesired particles in vapors of the electronic cigarette.

2. The filtering unit according to claim 1, wherein said attachment prongs are sized such that when said hollow chamber is positioned over said portion of said electronic cigarette, said filtering unit permanently attaches to said portion of said electronic cigarette.

3. The filtering unit according to claim 1, wherein said hollow housing further comprises a mouthpiece formed at said second end.

4. The filtering unit according to claim 1, wherein said filter pad comprises treated cellulose acetate fiber.

* * * * *